US008875897B2

(12) United States Patent
Chu et al.

(10) Patent No.: US 8,875,897 B2
(45) **Date of Patent: *Nov. 4, 2014**

(54) TRASH SEPARATOR

(71) Applicant: Uster Technologies AG, Uster (CH)

(72) Inventors: Youe-Tsyr Chu, Knoxville, TN (US); Johnathan W. Craps, Kodak, TN (US); Weichang Zhao, Oak Ridge, TN (US); Michael E. Galyon, Knoxville, TN (US); Hossein M. Ghorashi, Knoxville, TN (US)

(73) Assignee: Uster Technologies AG, Uster (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/925,906

(22) Filed: Jun. 25, 2013

(65) Prior Publication Data

US 2013/0334110 A1 Dec. 19, 2013

Related U.S. Application Data

(63) Continuation of application No. 13/523,219, filed on Jun. 14, 2012, now Pat. No. 8,496,114.

(51) Int. Cl.

| | |
|---|---|
| ***B07B 4/00*** | (2006.01) |
| ***B07B 7/00*** | (2006.01) |
| ***D01B 3/00*** | (2006.01) |
| ***B07B 4/02*** | (2006.01) |
| ***B07B 13/00*** | (2006.01) |

(52) U.S. Cl.

CPC ... *B07B 4/02* (2013.01); *D01B 3/00* (2013.01); *B07B 13/003* (2013.01)

USPC ..... 209/139.1; 209/142; 19/200

(58) Field of Classification Search

USPC ..... 19/200, 204, 66 CC, 100, 107, 108, 109, 19/112, 218, 233; 209/138, 139.1, 142

See application file for complete search history.

(56) References Cited

U.S. PATENT DOCUMENTS

| | | | | |
|---|---|---|---|---|
| 2,848,754 | A * | 8/1958 | Mayer, Jr. et al. | 209/142 |
| 4,382,857 | A * | 5/1983 | Laughlin | 209/23 |
| 5,270,787 | A | 12/1993 | Shofner et al. | |
| 5,321,496 | A | 6/1994 | Shofner et al. | |

(Continued)

FOREIGN PATENT DOCUMENTS

| | | |
|---|---|---|
| WO | 2011137553 | 11/2011 |
| WO | 2011137554 | 11/2011 |

*Primary Examiner* — David H Bollinger

(74) *Attorney, Agent, or Firm* — Luedeka Neely Group, P.C.; Rick Barnes

(57) ABSTRACT

An apparatus for processing a sample including fibers and trash, having a cylinder rotating in a first direction for receiving the sample. The cylinder has a surface with rigid pins. The pins engage and retain the fibers of the sample. A collection surface receives the trash that falls from the cylinder. A counter-flow of air moves in a separation region between the cylinder and the collection surface in a direction that is substantially perpendicular to and towards the underside of the cylinder. The counter-flow of air has at each position within the separation region an air-flow velocity that is sufficient for the counter-flow of air to blow the fibers that are not originally retained by the pins up toward the cylinder and thereby engaging the fibers with the cylinder, and yet insufficient to prevent gravity from pulling the trash downward through the counter-flow of air.

20 Claims, 2 Drawing Sheets

(56) References Cited

U.S. PATENT DOCUMENTS

| | | | | |
|---|---|---|---|---|
| 5,410,401 | A | 4/1995 | Shofner et al. | |
| 5,414,900 | A * | 5/1995 | Gillum et al. | 19/55 R |
| 5,430,301 | A | 7/1995 | Shofner et al. | |
| 5,469,253 | A | 11/1995 | Shofner et al. | |
| 5,539,515 | A | 7/1996 | Shofner et al. | |
| 5,822,972 | A * | 10/1998 | Patelke et al. | 57/408 |
| 6,089,378 | A * | 7/2000 | Mascheretti et al. | 209/143 |
| 6,188,479 | B1 | 2/2001 | Shofner et al. | |
| 6,615,454 | B1 * | 9/2003 | Anthony | 19/41 |
| 6,615,455 | B1 * | 9/2003 | Pinto | 19/105 |
| 7,597,200 | B2 * | 10/2009 | Christensen | 209/295 |
| 8,496,114 | B1 * | 7/2013 | Chu et al. | 209/139.1 |

* cited by examiner

TRASH SEPARATOR

FIELD

This application claims rights and priority on prior pending U.S. patent application Ser. No. 13/523,219 filed 2012 Jun. 14. This invention relates to the field of fiber quality measurement. More particularly, this invention relates to separating non-fiber entities (such as trash) from fibers (such as cotton).

BACKGROUND

Natural and man-made fibers are routinely assessed for a variety of different properties, so as to grade the fiber samples. These properties include things such as fiber length, strength, color, moisture content, crimp, fineness, and non-fiber content. For example, measuring the properties of cotton fiber so as to provide a grade for the quality of the cotton is an important step in determining the value of the fibers.

Natural fibers such as cotton can be contaminated by non-primary-fiber material, which is often generally referred to as trash. Such trash may be, for instance, husks, seed, twigs, bark, leaves, dirt, or rocks. Measuring the non-fiber content of a fiber sample is accomplished by separating the fibers in a fiber sample from as much of the non-fiber content in the fiber sample as possible, and weighing or otherwise quantifying at least two of: (1) the original fiber sample, (2) the fibers that were separated from the original fiber sample, and (3) the trash that was separated from the original fiber sample. Typically, anything that is not the desired fibers themselves is considered non-fiber content, and designated as trash.

Unfortunately, prior art separators typically allow significant quantities of fibers to remain mixed in with the separated trash, thus making it difficult to determine the total trash content of the original fiber sample, and also tend to take up a large amount of space.

What is needed, therefore, is a system that reduces problems such as those described above, at least in part.

SUMMARY

The above and other needs are met by the separation apparatus according to a first independent claim and the method according to a second independent claim. Various embodiments are defined in the dependent claims.

The embodiments of the invention provide below a separation cylinder a counter-flow of air moving vertically upward towards the underside surface of the separation cylinder. The counter-flow of air has a velocity sufficient to blow upward fibers not retained by the surface of the separation cylinder, yet insufficient to prevent gravity from pulling trash downward. Thus, the trash falls through the counter-flow of air onto a collection surface, where it can be weighed on a scale.

The separation apparatus for processing a fiber sample that includes both fibers and trash has a fiber-feeding device. It further includes a separation cylinder rotating in a first direction and receiving the fiber sample from the fiber-feeding device. The separation cylinder has a cylindrical surface with a length extending along a longitudinal axis. Rigid protrusions having distal ends extend from the cylindrical surface. The protrusions selectively engage and retain the fibers of the fiber sample. The trash is thereby separated from the fiber sample along a substantially downward direction. A collection surface receives the trash that falls downward from the separation cylinder. The separation apparatus further includes means for providing in a separation region between the separation cylinder and the collection surface a counter-flow of air moving in a direction that is substantially perpendicular to and towards the underside of the separation cylinder. In one embodiment, the counter-flow of air has at each position within the separation region an air-flow velocity sufficient for the counter-flow of air to blow the fibers that are not originally retained by the protrusions up toward the bottom of the separation cylinder, and yet insufficient to prevent gravity from pulling the trash downward through the counter-flow of air.

The separation region is a region, such as a funnel-like region, in which the air-flow velocity substantially fulfills the above conditions. The air-flow velocity need not be locally uniform within the separation region, but may rather vary in all three directions in space. In an embodiment where the means for providing the counter-flow of air includes a counter-flow chamber laterally confined by a wall, a region adjacent to the wall might not be part of the separation region, since the air-flow velocity tends to zero in direct vicinity to the wall and generally increases in a radial direction with increasing distance from the wall. The separation region starts where the air-flow velocity is sufficient to blow the fibers up; it is located in a central region, such as an axial region of the counter-flow chamber. The counter-flow of air according to the invention can be consistent, meaning the flow rate is independent of time, and laminar, such as without turbulences.

In one embodiment, the means for providing a counter-flow of air include a counter-flow chamber disposed below the separation cylinder, being laterally confined and open in a direction that is substantially perpendicular to and towards the underside surface of the separation cylinder, such that the counter-flow of air and the trash are able to pass through the counter-flow chamber.

The means for providing a counter-flow of air may include a vacuum source disposed adjacent the separation cylinder. Additionally or alternatively, the means for providing a counter-flow of air may include an excess-pressure source such as an air fan.

The means for providing a counter-flow of air can be such that an average air-flow velocity within the separation region is between about 10 m/min (0.17 m/s) and about 60 m/min (1.0 m/s). In one embodiment the average value is about 25 m/min (0.42 m/s). An optimum average air-flow velocity can be theoretically or experimentally determined. The determination of the air-flow velocity can be influenced by the type of fibers or trash to be separated, and by the kinetic energy and momentum given to the fiber and trash particles by the separation cylinder.

In one embodiment, the separation apparatus includes a scale for measuring the weight of the trash and any fibers admixed to the trash that are received by the collection surface. A correction module may be provided for visually detecting fibers on the collection surface and subtracting an estimated weight of the detected fibers from the weight of the mixture of trash and fibers.

The fiber-feeding device can include a feed roller disposed adjacent the separation cylinder, the feed roller for rotating in the rotational direction of the separation cylinder and presenting the fiber sample to the separation cylinder at a position where a feed roller tangential direction of motion is substantially opposite to a separation cylinder tangential direction of motion.

The separation apparatus may further include a vacuum source disposed adjacent the separation cylinder, the vacuum source for drawing an air flow away from the cylindrical surface of the separation cylinder and removing the fibers from the protrusions. The vacuum source may be identical to the vacuum source for providing a counter-flow of air mentioned above. The separation apparatus may still further include a lint deflector made of bent and parallel tines disposed along the separation cylinder in the direction of rotation to prevent clumps of the fiber sample from falling to the collection surface and to guide clumps along the tines and back to the separation cylinder and vacuum source. Such clumps will pass a second time around the separation cylinder, thus being opened, or will be removed by the vacuum source.

In one embodiment, the separation cylinder has a length of between about 25 cm and about 80 cm, and a diameter of between about 10 cm and about 30 cm. The separation cylinder is, for instance, rotatable at a rotational speed of between about 1000 rpm (16.7 $s^{-1}$) and about 2000 rpm (33.3 $s^{-1}$).

The protrusions may extend from the cylindrical surface of the separation cylinder at an angle that is inclined toward the rotational direction. The protrusions can include at least one of saw teeth and pins.

The separation apparatus may further include a knife edge extending parallel to the longitudinal axis and along substantially the entire length of an underside of the separation cylinder, and disposed adjacent the distal ends of the protrusions, for selectively removing from the fiber sample the trash that is not retained by the protrusions.

The separation apparatus can include a stilling chamber disposed below the separation region, the stilling chamber having air that is substantially stagnant, in that there is no forced air flow in any direction within the stilling chamber.

According to another aspect of the invention, there is described a method for processing a fiber sample that includes both fibers and trash. The fiber sample is fed onto a surface of a separation cylinder, the separation cylinder rotating in a rotational direction and having a cylindrical surface with a length extending along a longitudinal axis, and rigid protrusions having distal ends extending from the cylindrical surface. Fibers of the fiber sample are selectively engaged and retained with the separation cylinder. Trash that is not retained by the pins is selectively removed from the fiber sample in a substantially downward direction. The trash that has fallen downward from the separation cylinder is collected on a collection surface. The fibers and trash are contacted in a separation region between the separation cylinder and the collection surface with a counter-flow of air moving in a direction that is substantially perpendicular to and towards the underside of the separation cylinder. In one embodiment, the counter-flow of air has at each position within the separation region an air-flow velocity sufficient for the counter-flow of air to blow the fibers that are not originally retained by the protrusions up toward the bottom of the separation cylinder and thereby engaging the fibers with the separation cylinder, and yet insufficient to prevent gravity from pulling the trash downward through the counter-flow of air.

An average air-flow velocity within the separation region can be between about 10 m/min (0.17 m/s) and about 60 m/min (1.0 m/s), and in one embodiment is about 25 m/min (0.42 m/s).

The weight of the trash and any fibers admixed to the trash, collected on the collection surface can be measured.

In one embodiment, fibers on the collection surface are visually detected with a correction module, and an estimated weight of the fibers is subtracted from the weight of the mixture of trash and fibers.

The fiber sample may be presented to the separation cylinder with a feed roller that is disposed adjacent the separation cylinder, the feed roller rotating in the rotational direction of the separation cylinder and at a position where a feed roller tangential direction of motion is substantially opposite to a separation cylinder tangential direction of motion.

In one embodiment an air flow is drawn away from the cylindrical surface of the separation cylinder and removes the fibers from the protrusions with a vacuum source disposed adjacent the separation cylinder.

The separation cylinder can rotate at a rotational speed of between about 1000 rpm (16.7 $s^{-1}$) and about 2000 rpm (33.3 $s^{-1}$).

Expressions such as "upwards," "downwards," "below," "above," "horizontal," "vertical," "height," and so forth refer in the present document to the gravitational field of the earth, in which the apparatus according to the invention is deemed to stand.

In some embodiments, the trash that falls onto the collection surface is at atmospheric pressure. Thus, it can easily be collected and weighed on the scale. This enables a relatively low-cost instrument for measuring trash gravimetrically.

In the vertical separation region according to one embodiment, air drag and gravity exert a force on the particles. The two forces are opposite to each other. They can be balanced with respect to each other by adjusting the velocity of the vertical air-flow. With an appropriate air-flow velocity, trash particles would never be returned to the separation cylinder, independent of the height of the separation region.

One single separation cylinder is sufficient in some embodiments of the present invention. This reduces the space requirements and the costs of the apparatus according to the invention. Nevertheless, the use of more than one separation cylinder is not excluded from other embodiments.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

With reference now to the figures, there are described various embodiments of a trash separator 100, which is operable for separating trash particles 104 from fibers 106 in a fiber sample 102. The fiber sample 102 may take various forms. In one embodiment, the fiber sample 102 is cotton, but in other embodiments the fiber sample 102 is formed of other natural or man-made fibers, or combinations thereof. The fiber sample 102 includes both individual fibers 106 and trash particles 104.

Figure 1:
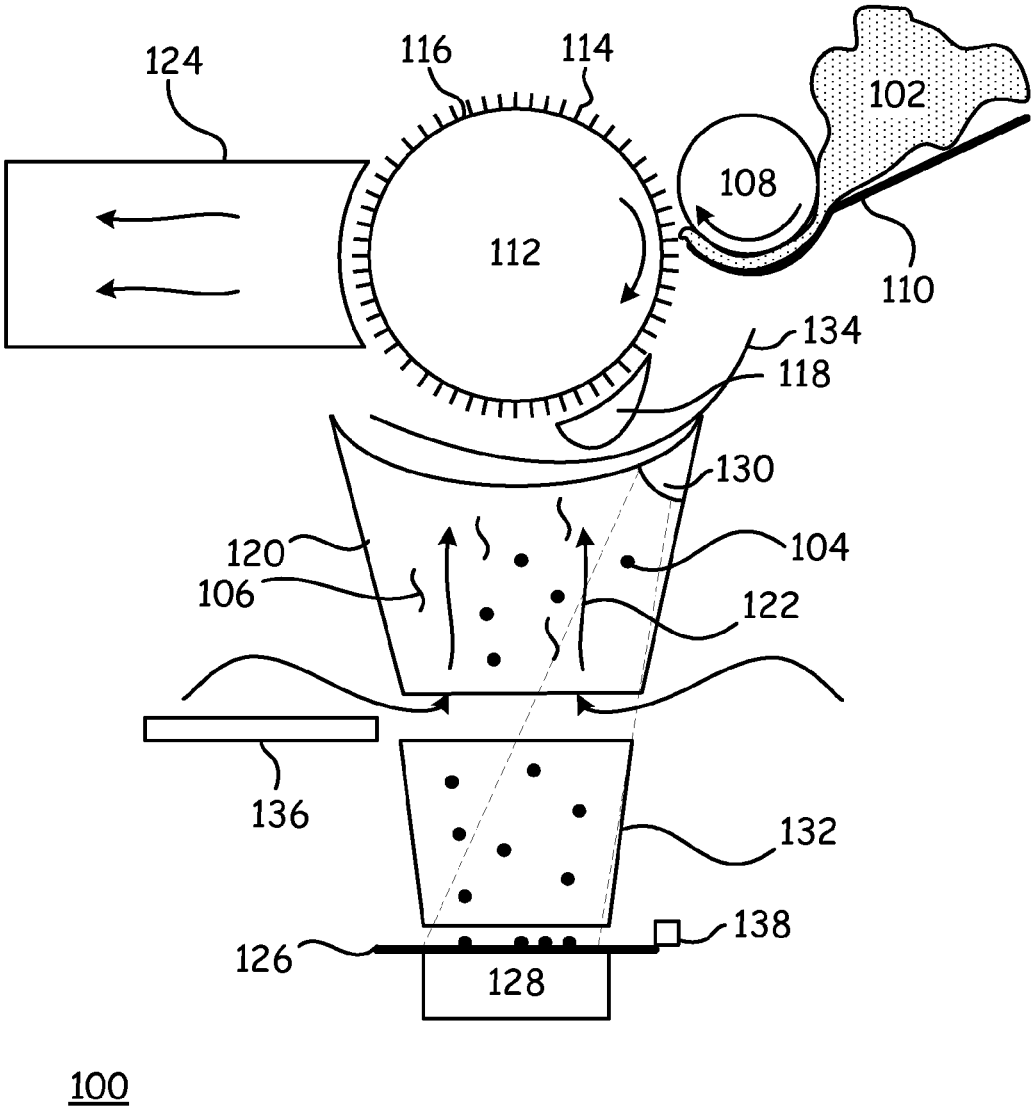
FIG. 1 depicts a trash separation apparatus from an end view of a separation cylinder according to an embodiment of the present invention.

In the embodiment depicted in FIG. 1, the fiber sample 102 is presented to the trash separator 100 by feeding it between a feed roller 108 and a feed surface, or feed plate, 110. The feed roller 108 rotates in a first direction (such as indicated in FIG. 1) at a rotational rate of from about one rotation per minute (0.017 $s^{-1}$) to about four rotations per minute (0.067 $s^{-1}$), such that the fiber sample 102 is pulled between the feed roller 108 and the feed surface 110. In the embodiment as depicted, the feed roller 108 rotates in a clockwise direction, pulling the fiber sample 102 toward a separation cylinder 112, which also rotates in the first direction (clockwise, as indicated in this embodiment as depicted) and at a rotational rate of from about one thousand rotations per minute (16.7 $s^{-1}$) to about two thousand rotations per minute (33.3 $s^{-1}$).

In some embodiments the feed roller 108 is formed of a smooth-surfaced soft-matter coating (such as rubber) on a steel shaft, which adjusts to the varying thickness of the fiber sample 102 and retains the fiber sample 102 along the feed roller 108 axis, to prevent premature release of the fiber sample 102. The feed roller 108 is adjustable to make the gap between the feed roller 108 and the feed surface 110 larger or smaller, such as according to the varying thickness of the fiber sample 102. Therefore, the feed roller 108 holds the fiber sample 102 firmly while being combed by the separation cylinder 112, effectively reducing the generation of unopened fiber clumps that might be pulled out and thrown down.

Figure 2:
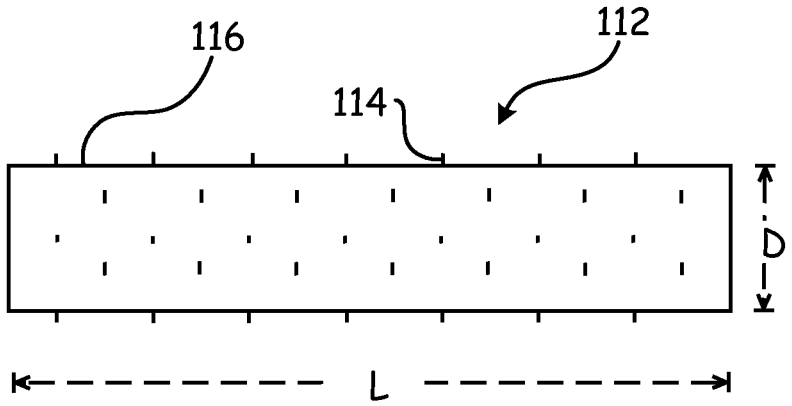
FIG. 2 is a front view of a separation cylinder according to an embodiment of the present invention.

FIG. 2 depicts a front view of the separation cylinder 112. In some embodiments the separation cylinder 112 has a length L (in the axial direction) of from about 250 mm to about 800 mm, and a diameter D of from about 100 mm to about 300 mm. In some embodiments the feed roller 108 has a length that is substantially equal to that of the separation cylinder 112, and a diameter of from about 35 mm to about 75 mm.

Returning to FIG. 1, the feed roller 108 and the separation cylinder 112 are disposed adjacent one another at a first position, at which the tangential direction of motion of the feed roller 108 and the tangential direction of motion of the separation cylinder 112 are substantially opposite one another. The tangential direction of motion is defined as the direction of travel of a point on a surface of a rotating body. The feed surface 110 keeps the fiber sample 102 engaged by the feed roller 108 until the fiber sample 102 is disposed at substantially the first position (as opposed to releasing it much earlier), at which position the fiber sample 102 is contacted by the separation cylinder 112, which is moving in the opposite tangential direction. These opposing directions of motion between the feed roller 108 and the separation cylinder 112 produce a severe shearing force on the fiber sample 102 that pulls it apart. This results in an aggressive opening action and a better separation of the trash from the fibers.

As the fiber sample 102 separates, the fibers 106 tend to be predominantly engaged and retained by protrusions 114 of the separation cylinder 112, while the trash particles 104 of the fiber sample 102 tend to remain predominantly unengaged by the protrusions 114. Some of the trash 104 is separated from the fibers 106 at this point, as the protrusions 114 tend to bat the trash 104 in a downward direction and away from the fibers 106 that are engaged by the protrusions 114. In some embodiments the protrusions 114 are saw-tooth structures, and in other embodiment the protrusions 114 are pins. In some embodiments, a combination of saw teeth and pins comprise the protrusions 114.

Figure 3:
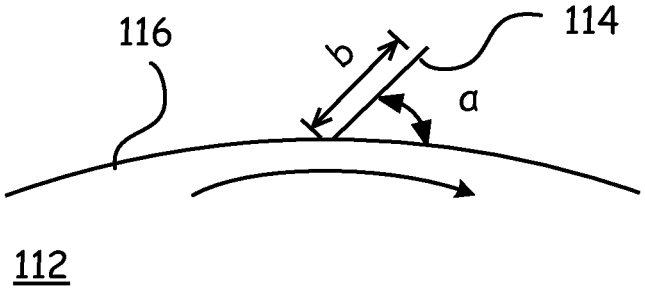
FIG. 3 is a side view of a separation cylinder and protrusions according to an embodiment of the present invention.

In some embodiments, and as depicted in more detail in FIG. 3, the protrusions 114 protrude from the cylindrical surface 116 of the separation cylinder 112 at an angle $\alpha$ in relation to the surface 116 of the separation cylinder 112. The angle $\alpha$ is from about fifty degrees to about ninety degrees, and leans into the direction of rotation of the separation cylinder 112. The length b of the protrusions 114 is from about 2 mm to about 4 mm.

In some embodiments the protrusions 114 are evenly spaced-apart across the surface 116 of the separation cylinder 112. In some embodiments the spacing of the protrusions 114 across the surface 116 depends upon the type of fiber sample 102 being tested. For example, for one type of fiber sample 102 it may be desirable to place the protrusions 114 relatively further apart, while with another fiber sample 102 it may be desirable to place the protrusions 114 relatively closer together.

Returning again to FIG. 1, a knife 118 is disposed adjacent the separation cylinder 112, such that the knife 118 extends parallel to the longitudinal axis and along substantially the entire length of the separation cylinder 112. The knife 118 is positioned such that any trash 104 that is not entrained within the protrusions 114 is predominantly removed from the fibers 106 that are entrained within the protrusions 114, and is deflected in a downward direction towards a counter-flow chamber 120. In some embodiments, the edge of the knife 118 is disposed very close to the ends of the protrusions 114. In some embodiments the edge of the knife 118 is straight and does not interdigitate the protrusions 114.

Some embodiments include a lint deflector 134, such as made of parallel and bent metal tines disposed along the direction of rotation of the separation cylinder 112, which help prevent large clumps of material from falling. The lint deflector 134 works as a filter or screen to help prevent clumps of fibers 106 from dropping to a trash collection surface 126, but let the trash 104 to pass through. The tines of the lint deflector 134 in one embodiment are parallel to each other and bent along the direction of the air flow. The tines in one embodiment deflect the fiber clumps with a size larger than about six millimeters without catching individual fibers 106. The ends of the wires of the lint deflector 134 are open near a vacuum source 124 so that material that is caught by the lint deflector 134 is not retained by the lint deflector 134, but instead will be drawn off by the vacuum source 124.

The counter-flow chamber 120 provides an upward-directed counter-flow of air 122 that enters the counter-flow chamber 120 at the bottom of the counter-flow chamber 120 (as indicated in FIG. 1), such that the air flow 122 is in an upward direction and substantially opposite to the direction of travel of the falling trash particles 104 and the few fibers 106 that were not originally engaged by the protrusions 114. The purpose of the air flow 122, which in some embodiments is generated by the vacuum source 124 and airflow from the rotating separation cylinder 112, is to blow such non-engaged fibers 106 back up toward the bottom of the separation cylinder 112, such that they engage with the protrusions 114, or are carried by the air flow from the rotating separation cylinder 112 to the vacuum source 124, and do not continue down through the counter-flow chamber 120. The upwardly directed air flow 122 changes the trajectory of the falling fibers 106 by about 180 degrees, whereas an air flow in any other direction, such as a horizontal cross-flow of air, would only change the fiber 106 trajectory by no more than about ninety degrees.

To accomplish this, the air flow 122 has, in some embodiments, at least in a separation region within the counter-flow chamber 120, at each position an air-flow velocity such that any fibers 106 that attain the separation region are generally lofted upwards by the air flow 122 toward the separation cylinder 112. However, the velocity of the air flow 122 is generally insufficient to prevent gravity and possibly other influences such as momentum from drawing the trash particles 104 downward through the counter-flow chamber 120. The separation region is a central part of the counter-flow chamber 120, extending like a funnel from the bottom of the counter-flow chamber 120 to its top. Regions in the vicinity of the walls of the counter-flow chamber 120 might not belong to the separation region, since the air-flow velocities in such regions might be too low to loft the fibers 106 upwards.

An appropriate choice of the air-flow velocities within the separation region can enhance the separation of the trash from the fibers. One method for estimating the air-flow velocity is next described. Other methods may also be used.

We consider a particle—fiber or trash—consisting of a uniform material and having a certain shape and certain dimensions, in a stationary, laminar, homogeneous and isotropic air flow directed upwards. The air flow exerts on the particle a force directed upwards, the flow resistance, which depends on the air-flow velocity. We calculate the air-flow velocity v necessary for compensating the gravitational force on the particle. In an air flow with this "threshold velocity" v, the particle would float at the same level; below the threshold velocity v the particle would fall down, above the threshold velocity v it would be lofted up. The threshold velocity v according to this model is:

$$v = \sqrt{k\frac{\rho}{\rho_A}gh},$$

Where:

k is a shape factor depending on the geometric shape of the particle,

ρ is the mass density of the particle, $\rho_A$ is the mass density of air ($\rho_A$=1.2 kg/m$^3$), g is the gravitational acceleration (g=9.81 m/s$^2$), and h is a characteristic height of the particle, i.e., a particle dimension in line with the air-flow direction.

In a first example, let us consider a cylindrical cotton fiber floating with its axis in the horizontal direction in the air flow. The following values apply for this example:

k=1.3,

ρ=1510 kg/m$^3$, and h=diameter of the cylinder=20 μm.

We get a threshold velocity of v=0.57 m/s=34 m/min. The threshold velocity v is apparently independent of the fiber length.

In a second example, we may consider a spherical ball of soil with:

k=3.0,

ρ=1400 kg/m$^3$, and h=diameter of the sphere=0.2 mm.

We get a threshold velocity of v=2.6 m/s=156 m/min.

It follows from the two above examples that cotton fibers with a diameter of 20 μm and balls of soil with a diameter of 0.2 mm will be separated in a vertical counter-flow with air-flow velocities within the range between 34 m/min and 156 m/min.

Whereas the model presented above is useful for theoretically estimating the required air-flow velocities, an experimental fine tuning of the apparatus 100 according to the invention with regard to the air-flow velocities is recommended. Experiments have shown that an average velocity of the air flow 122 through the counter-flow chamber 120 should be adjustable from about 10 m/min (0.17 m/s) to about 60 m/min (1.0 m/s), depending upon the type of fiber sample 102 being tested and the trash 104 to be separated. For example, when a heavier fiber 106 is being tested, then the air flow 122 may flow through the counter-flow chamber 120 at a relatively faster rate, to reduce the occurrence of the heavier fibers 106 falling through the counter-flow chamber 120. On the other hand, when a lighter fiber 104 is being tested, the air flow 122 may flow through the counter-flow chamber 120 at a relatively slower rate, to reduce the occurrence of lighter trash particles 104 being drawn upwards toward the separation cylinder 112 and the vacuum source 124. The kinetic energy and momentum given to the fiber and trash particles 106, 104 by the rotating separation cylinder 112 can also be allowed for in the determination of an optimum average air-flow velocity. A high rotational rate and/or a large diameter D of the separation cylinder 112 will, in most cases, require a higher air-flow velocity, to reduce the occurrence of fibers 106 dashing through the counter-flow chamber 120. In one embodiment the average air-flow velocity for cotton fibers is 25 m/min (0.42 m/s).

In some embodiments, a vacuum source 124 is disposed adjacent the separation cylinder 112. In some embodiments, the vacuum source 124 is controlled to maintain a stable air flow 122 in the counter-flow chamber 120. The vacuum source 124 draws an air flow away from the separation cylinder 112, and removes the fibers 106 that were engaged by the protrusions 114 from the separation cylinder 112. The vacuum source 124 is disposed after the knife 118, relative to the direction of rotation of the separation cylinder 112, as depicted in FIG. 1. In some embodiments the vacuum source 124 creates the air flow 122. Thus, one and the same vacuum source 124 can be used for removing the fibers 106 from the separation cylinder 112 and for generating the air flow 122.

In the embodiment as depicted, the trash particles 104 that fall down through the counter-flow chamber 120 then fall through a stilling chamber 132 in which the air is substantially stagnant, in that there is no forced air flow in any direction. The trash particles 104 fall down through the chamber 132 and onto a collection surface 126, such as a tray of a scale 128. Because of the counter-flow of air 122, few or no fibers 106 attain the collection surface 126. Thus, the apparatus 100 achieves a highly successful separation of the fibers 106 and the trash 104 of the fiber sample 102. Some embodiments include a trash vacuum wiper bar 138 to remove trash 104 (and fibers 106, as needed) from the tray 126. The stilling chamber 132 tends to ensure that the trash 104 that falls onto the collection surface 126 is at atmospheric pressure. Thus, it can more easily be collected and weighed on the scale 128.

The counter-flow chamber 120 and the stilling chamber 132 have an opening between them that allows air to enter the counter-flow chamber 120 and flow upward to the vacuum source 124. The counter-flow of air 122 works as a filter for the freely flying loose fibers 106 to prevent them from dropping to the trash collection surface 126. An excess-pressure source (not drawn) such as an air fan could be provided at the opening between the counter-flow chamber 120 and the stilling chamber 132 as an alternative or additional means for providing a counter-flow of air.

In some embodiments, the trash content of the fiber sample 102 is determined by measuring the mass of the fiber sample 102 before it is processed through the trash separator 100, and then measuring the mass of the trash particles 104, such as by weighing the collection surface 126 and the trash 104 disposed thereon by means of the scale 128. As desired, the trash 104 content as a percentage of the total weight of the fiber sample 102 can be calculated. In some embodiments, the mass of the fibers 106 that are eventually drawn off by the vacuum source 124 can also be measured and used in similar calculations. In some embodiments, an air curtain plate 136 is disposed between the counter-flow chamber 120 and the stilling chamber 132 or between the stilling chamber 132 and the collection surface 126, and is used to seal off the collection surface 126 to minimize air currents 122 when the trash 104 is being weighed.

Some fibers 106 still might attain the collection surface 126. In some embodiments, these fibers 106 are manually removed before weighing the collection surface 126. In other embodiments, the weight of the fibers 106 on the collection surface is determined with a correction module 130 that visually detects the fibers 106 on the collection surface 126, estimates the weight of the detected fibers 106, and subtracts that estimated weight from the weight of the mixture of trash 104 and fibers 106 on the collection surface 126, thus yielding the weight of the trash particles 104.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A separation apparatus for processing a fiber sample that includes both fibers and trash, the separation apparatus comprising:

a fiber-feeding device, a separation cylinder disposed adjacent the fiber-feeding device for rotating in a rotational direction and receiving the fiber sample from the fiber-feeding device, the separation cylinder having a cylindrical surface with a length extending along a longitudinal axis, and rigid protrusions having distal ends extending from the cylindrical surface, the protrusions for selectively engaging and retaining the fibers of the fiber sample, the trash thereby separating from the fiber sample along a substantially downward direction, and a collection surface for receiving the trash that falls downward from the separation cylinder, means for providing in a separation region between the separation cylinder and the collection surface a counter-flow of air moving in a direction that is substantially perpendicular to and towards the underside surface of the separation cylinder, the counter-flow of air having at each position within the separation region an air-flow velocity sufficient for the counter-flow of air to blow the fibers that are not originally retained by the protrusions up toward the bottom of the separation cylinder and thereby engaging the fibers with the separation cylinder, and yet insufficient to prevent gravity from pulling the trash downward through the counter-flow of air.

2. The separation apparatus of claim 1, wherein the means for providing a counter-flow of air comprise a counter-flow chamber disposed below the separation cylinder, being laterally confined and open in a direction that is substantially perpendicular to and towards the underside surface of the separation cylinder, such that the counter-flow of air and the trash are able to pass through the counter-flow chamber.

3. The separation apparatus of claim 1, wherein the means for providing a counter-flow of air comprise a vacuum source disposed adjacent the separation cylinder.

4. The separation apparatus of any of claim 1, wherein the means for providing a counter-flow of air are such that an average air-flow velocity within the separation region is between about 10 m/min and about 60 m/min.

5. The separation apparatus of claim 1, further comprising a scale for measuring the weight of the trash, and any fibers admixed to the trash, received by the collection surface.

6. The separation apparatus of claim 5, further comprising a correction module for visually detecting fibers on the collection surface and subtracting an estimated weight of the detected fibers from the weight of the mixture of trash and fibers.

7. The separation apparatus of claim 1, wherein the fiber-feeding device comprises a feed roller disposed adjacent the separation cylinder, the feed roller for rotating in the rotational direction of the separation cylinder and presenting the fiber sample to the separation cylinder at a position where a feed roller tangential direction of motion is substantially opposite to a separation cylinder tangential direction of motion.

8. The separation apparatus of claim 1, further comprising a vacuum source disposed adjacent the separation cylinder, the vacuum source for drawing an air flow away from the cylindrical surface of the separation cylinder and removing the fibers from the protrusions.

9. The separation apparatus of claim 8, further comprising a lint deflector made of bent and parallel tines disposed along the separation cylinder in the direction of rotation to prevent clumps of the fiber sample from falling to the collection surface and to guide clumps along the tines and back to the separation cylinder and vacuum source.

10. The separation apparatus of claim 1, wherein the separation cylinder has a length of between about 25 cm and about 80 cm, and a diameter of between about 10 cm and about 30 cm.

11. The separation apparatus of claim 1, wherein the separation cylinder is rotatable at a rotational speed of between about 1000 rpm and about 2000 rpm.

12. The separation apparatus of claim 1, wherein the protrusions extend from the cylindrical surface of the separation cylinder at an angle that is inclined toward the rotational direction.

13. The separation apparatus of claim 1, wherein the protrusions comprise at least one of saw teeth and pins.

14. The separation apparatus of claim 1, further comprising a knife edge extending parallel to the longitudinal axis and along substantially the entire length of an underside of the separation cylinder, and disposed adjacent the distal ends of the protrusions, for selectively removing from the fiber sample the trash that is not retained by the protrusions.

15. The separation apparatus of claim 1, further comprising a stilling chamber disposed below the separation region, the stilling chamber having air that is substantially stagnant, in that there is no forced air flow in any direction within the stilling chamber.

16. A method for processing a fiber sample that includes both fibers and trash, the method comprising the steps of:

feeding the fiber sample onto a surface of a separation cylinder, the separation cylinder rotating in a rotational direction and having a cylindrical surface with a length extending along a longitudinal axis, and rigid protrusions having distal ends extending from the cylindrical surface, selectively engaging and retaining fibers of the fiber sample with the separation cylinder, selectively removing from the fiber sample trash that is not retained by the pins in a substantially downward direction, and collecting on a collection surface the trash that has fallen downward from the separation cylinder, the fibers and trash contacted in a separation region between the separation cylinder and the collection surface with a counter-flow of air moving in a direction that is substantially perpendicular to and towards the underside surface of the separation cylinder, the counter-flow of air having at each position within the separation region an air-flow velocity sufficient for the counter-flow of air to blow the fibers that are not originally retained by the protrusions up toward the bottom of the separation cylinder and thereby engaging the fibers with the separation cylinder, and yet insufficient to prevent gravity from pulling the trash downward through the counter-flow of air.

17. The method of claim 16, further comprising measuring the weight of the trash and any fibers admixed to the trash that is collected on the collection surface.

18. The method of claim 17, further comprising:

visually detecting fibers on the collection surface with a correction module, and subtracting an estimated weight of the fibers from the weight of the mixture of trash and fibers.

19. The method of claim 16, further comprising presenting the fiber sample to the separation cylinder with a feed roller that is disposed adjacent the separation cylinder, the feed roller rotating in the rotational direction of the separation cylinder and at a position where a feed roller tangential direction of motion is substantially opposite to a separation cylinder tangential direction of motion.

20. The method of claim 16, further comprising drawing an air flow away from the cylindrical surface of the separation cylinder and removing the fibers from the protrusions with a vacuum source disposed adjacent the separation cylinder.

* * * * *